US007677552B2

(12) United States Patent
Hugues et al.

(10) Patent No.: US 7,677,552 B2
(45) Date of Patent: Mar. 16, 2010

(54) UNSTACKER APPARATUS HAVING A RETRACTABLE BLOWER MEMBER

(75) Inventors: Damien Hugues, Valence (FR); Robert Vivant, Chabeuil (FR)

(73) Assignee: Solystic, Gentilly Cedex (FR)

( * ) Notice: Subject to any disclaimer, the term of this patent is extended or adjusted under 35 U.S.C. 154(b) by 355 days.

(21) Appl. No.: 11/908,042

(22) PCT Filed: Jun. 12, 2007

(86) PCT No.: PCT/FR2007/051418

§ 371 (c)(1),
(2), (4) Date: Sep. 7, 2007

(87) PCT Pub. No.: WO2008/015347

PCT Pub. Date: Feb. 7, 2008

(65) Prior Publication Data

US 2009/0148265 A1 Jun. 11, 2009

(30) Foreign Application Priority Data

Aug. 3, 2006 (FR) ..... 06 53270

(51) Int. Cl.
*B65H 1/02* (2006.01)
*B65H 3/14* (2006.01)

(52) U.S. Cl. ..... 271/97; 271/98; 271/31.1; 271/149; 271/150

(58) Field of Classification Search ..... 271/97, 271/98, 31.1, 149, 150
See application file for complete search history.

(56) References Cited

U.S. PATENT DOCUMENTS

| | | | | |
|---|---|---|---|---|
| 3,847,383 | A | | 11/1974 | Wojtowicz et al. |
| 5,308,052 | A | * | 5/1994 | Roch et al. ..... 271/2 |
| 5,379,992 | A | * | 1/1995 | Holmes et al. ..... 271/2 |
| 5,722,811 | A | * | 3/1998 | Schum et al. ..... 414/796 |

FOREIGN PATENT DOCUMENTS

| | | |
|---|---|---|
| EP | 0 562 954 A1 | 9/1993 |
| EP | 1 228 990 A2 | 8/2002 |
| FR | 1 416 727 | 11/1965 |
| FR | 2 797 856 A1 | 3/2001 |

* cited by examiner

*Primary Examiner*—Patrick H Mackey
*Assistant Examiner*—Luis Gonzalez
(74) *Attorney, Agent, or Firm*—Rothwell, Figg, Ernst & Manbeck, P.C.

(57) ABSTRACT

Unstacker apparatus (1) for unstacking flat items (E), the unstacker apparatus comprising a flat item feed magazine (M) in which the flat items are disposed in a stack and on edge and are moved in a certain direction (D) until they reach an unstacking plate (6) disposed in alignment with said feed magazine, whereupon they are ejected one-by-one in a perpendicular direction (P) that is perpendicular to said certain direction (D), the unstacker apparatus further comprising a blower member (13) which is disposed so as to blow a jet of air onto the flat items, and which is mounted in a manner such as to be retractable into the unstacking plate.

8 Claims, 4 Drawing Sheets

UNSTACKER APPARATUS HAVING A RETRACTABLE BLOWER MEMBER

CROSS REFERENCE TO RELATED APPLICATIONS

This application is a 35 U.S.C. §371 National Phase Application from PCT/FR2007/051418, filed Jun. 12, 2007, and designating the Unites States, which claims the benefit of France Patent Application No. 0653270, filed Aug. 3, 2006.

BACKGROUND OF THE INVENTION

1. Field of the Invention

The invention relates to unstacker apparatus for unstacking flat items, the unstacker apparatus comprising a flat item feed magazine in which the flat items are disposed in a stack and on edge and are moved in a certain direction until they reach an unstacking plate disposed in alignment with said feed magazine, whereupon they are ejected one-by-one in a perpendicular direction that is perpendicular to said certain direction, the unstacker apparatus further comprising a blower member disposed so as to blow a jet of air onto the flat items.

The invention relates more particularly to unstacker apparatus for unstacking postal items of small format and of large format in a postal sorting machine. The blower member contributes to fanning out the postal items at the front of the stack against the unstacking plate, and makes it possible to limit occurrences of bunches of postal items that fail to separate.

2. Discussion of the Background Art

Patent Document FR 2 797 856 discloses apparatus for unstacking postal items that is designed to be mounted on a postal sorting machine. That apparatus 1, described below with reference to FIG. 1, is provided with a motor-driven magazine M having a substantially horizontal surface and comprising, in particular, a conveyor belt 2 on which an operator disposes postal items E on edge that are to be put into series, and a substantially vertical paddle 3 that is also motor-driven, that is mounted to move along a rail 4, and that is designed to push the stack in a certain longitudinal direction indicated by arrow D towards an unstacking plate 6. The postal items in the stack are aligned and held laterally by a jogger edge 5 extending vertically in said longitudinal direction along one edge of the magazine M. The unstacking plate 6 extends vertically and each first postal item in the stack having its large face bearing against the unstacking plate is ejected in a direction P that is perpendicular to the direction D towards the outlet of the unstacker.

The unstacking plate 6 is provided with an opening in the plane of which a perforated belt 8 is moved, which perforated belt co-operates with a suction nozzle (not shown) mounted behind the perforated belt. In operation, the stack of postal items E is moved by the conveyor belt 2 and by the paddle 3 towards the unstacking plate 6, and the first postal item in the stack comes to bear against the unstacking plate 6. That postal item in the stack, i.e. the postal item that has its large face pressed against the unstacking plate and that is referred to as the "current first postal item" E1, is ejected in the direction P under the combined effect of the suction force from the nozzle and of the movement of the perforated belt 9. That postal item is nipped between motor-driven wheels 9, 10 having vertical axes and made of elastically deformable elastomer so that it is ejected at the outlet of the unstacker apparatus that is situated in the plane of the plate 6.

All of the postal items in the stack are thus successively put into series one behind another in the same way, i.e. the postal item E2 disposed in the stack immediately behind the current first postal item E1, is ejected at the outlet of the unstacker immediately after the postal item E1.

In general, the postal items unstacked one-by-one are conveyed in series and on edge so as to be brought past a read head. An image of the face bearing the destination address of each postal item is extracted by the read head and is processed in an automatic address recognition system by Optical Character Recognition (OCR) so that the postal items are directed to specific sorting outlets.

With the unstacker apparatus of the Patent Document FR 2 797 856, a non-negligible proportion of postal items are observed to be taken in bunches. The term "bunch" is used to mean that a plurality of (generally two) postal items have been ejected simultaneously by the unstacker apparatus. Such postal item bunching give rise to sorting errors that are detrimental to the reliability of the sorting or to the throughput of the sorting machine because detection of such postal items results in them being rejected to a rejects sorting outlet followed by them being sorted manually.

Patent Document EP 0 562 954 discloses a solution to that bunching problem. That solution, presented in FIG. 2, consists in blowing a jet of air 11 onto the first few postal items in the stack of postal items E, i.e. onto the postal items that are close to the unstacking palate 6, e.g. between the first postal item E1 and the second postal item E2. The jet of air 11 is propelled by means of a blower member or strip 12. The jet of air 11 makes it possible to fan out the first few postal items in the stack relative to one another so that when the first item E1 is driven by the perforated belt 8, the second postal item E2, dissociated from the postal item E1, is not entrained by the postal item E1. The blower strip 12 is disposed at a height such that it overlies all formats of postal item that are accepted by the machine, including the largest format of postal items.

In unstacker apparatus suitable for unstacking both large-format postal items and small-format postal items, the blower strip thus finds itself very high up from the top edges of small-format postal items, and the effectiveness of the jet of air 11 in fanning out small-format postal items properly is therefore diminished. Unfortunately, bunching mainly affects small-format postal items.

SUMMARY OF THE INVENTION

An object of the invention is thus to mitigate the above-described drawback by proposing apparatus mainly aimed at limiting the proportion of bunches for small-format postal items, in particular in a sorting machine that is suitable for handling both small-format and large-format postal items.

To this end, the invention provides unstacker apparatus for unstacking flat items, the unstacker apparatus comprising a flat item feed magazine in which the flat items are disposed in a stack and on edge and are moved in a certain direction until they reach an unstacking plate disposed in alignment with said feed magazine, whereupon they are ejected one-by-one in a perpendicular direction that is perpendicular to said certain direction, the unstacker apparatus further comprising a blower member disposed so as to blow a jet of air onto the flat items, said unstacker apparatus being characterized in that said blower member is mounted in a manner such as to be retractable into the unstacking plate.

The blower member can then be disposed at a height appropriate to the size of the small-format postal items without obstructing handling/unstacking of large-format postal items. In operation, the blower member overlies the small-format postal items and retracts when a large-format postal item is pressed against the unstacking plate.

Advantageously, said blower member is mounted to be retracted by moving in translation in said certain direction.

In a first embodiment of the invention, said blower member retracts into the unstacking plate against drive from a resilient return element, and more particularly from a spring. The blower member is then retracted by the thrust force exerted on the blower member by the current large-format postal item to be unstacked.

In another particular embodiment of the invention, said blower member retracts into the unstacking plate under drive from a mechanical control element in response to reception of a signal delivered by a sensor, which sensor is, for example, an optical reflection sensor disposed in the unstacking plate, a mechanical contact sensor, or an optical barrier sensor for detecting the presence of a large-format postal item at the head of the stack of postal items to be unstacked.

The invention also provides a machine for handling postal items, which machine includes unstacker apparatus as defined above.

BRIEF DESCRIPTION OF THE DRAWINGS

The invention can be better understood on reading the following description with reference to the drawings. The following description is given merely by way of indication that in no way limits the invention.

In the drawings.

DETAILED DESCRIPTION OF THE PREFERRED EMBODIMENTS

Figure 2:
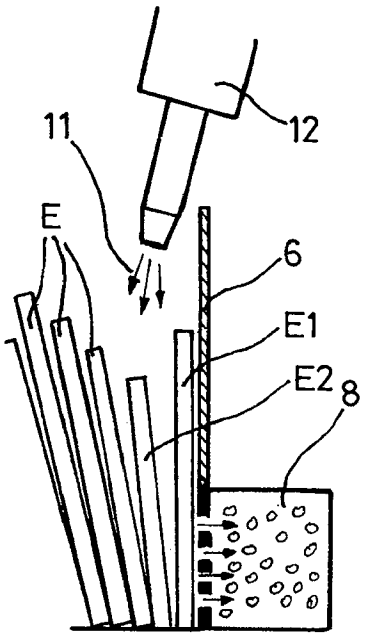
FIG. 2 shows a blower strip arranged as in the prior art.
Figure 1:
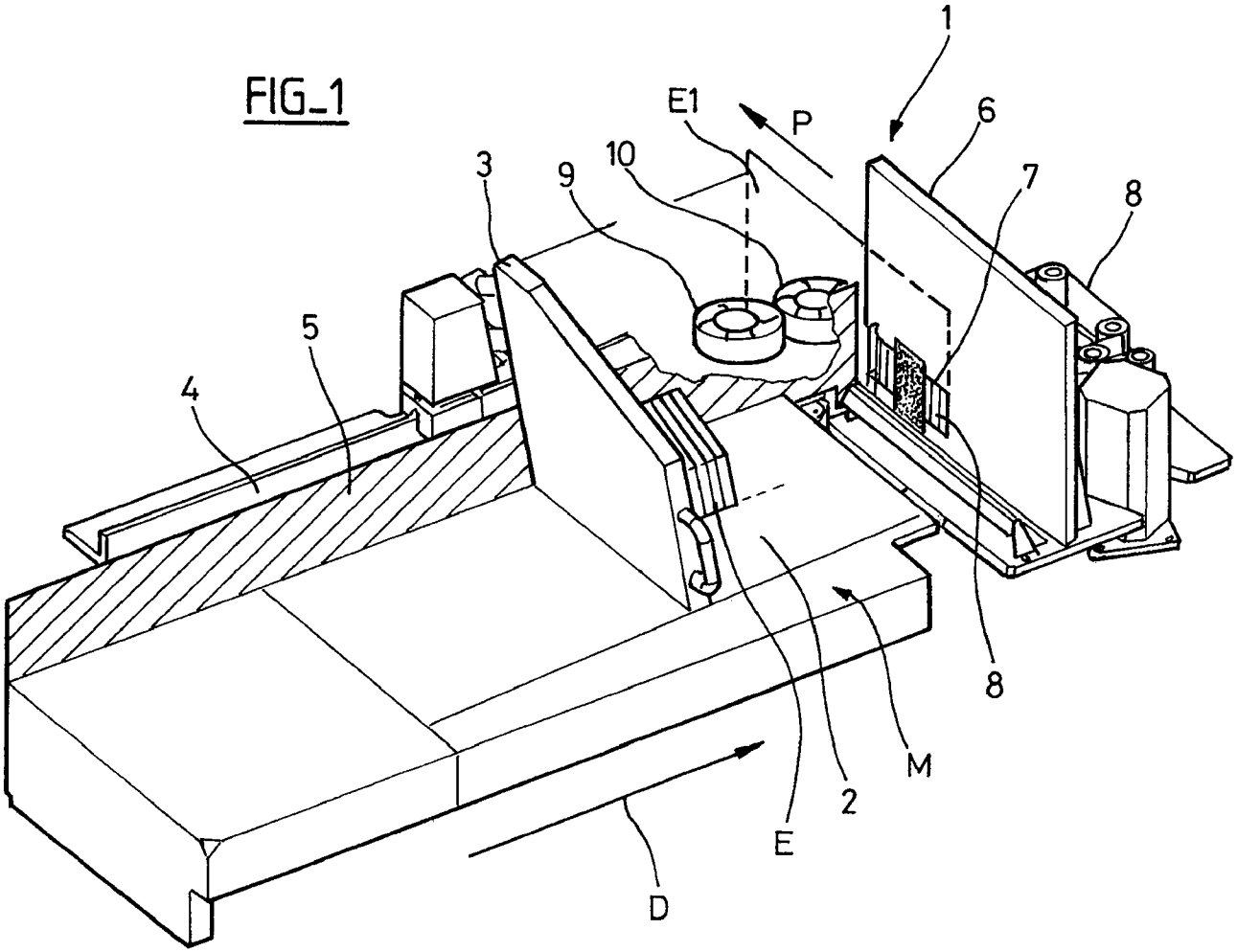
FIG. 1 is a perspective view of feed apparatus for a postal item unstacker that is known from the prior art.
Figure 3:
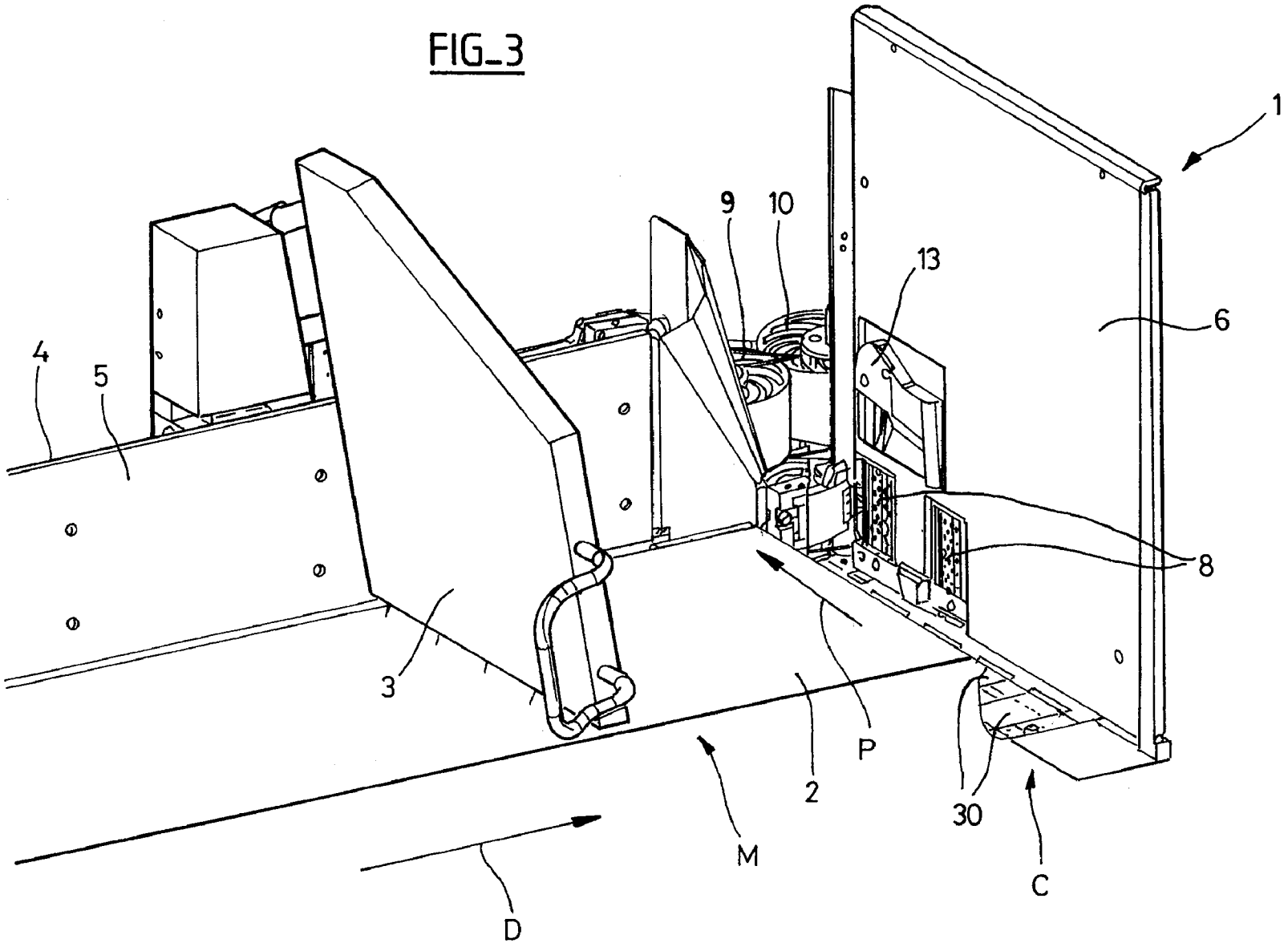
FIG. 3 is a perspective view of unstacker apparatus of the invention having a retractable blower strip.

FIG. 3 shows unstacker apparatus 1 for a postal sorting machine of the invention. The elements that are in common with the prior art apparatus shown in FIG. 1 are given like reference numerals.

The unstacker apparatus 1 comprises a motor-driven magazine M comprising a conveyor belt 2 and a substantially vertical paddle 3 for pushing postal items (not shown) disposed in a stack and on edge towards an unstacking plate 6, the stack of postal items being in front of the paddle in the longitudinal direction D.

The motor-driven magazine M further comprises a motor-driven drop-forming channel C disposed between the conveyor belt 2 and the unstacking plate 6. The bottom of the drop-forming channel, situated at a distance of about 100 millimeters (mm) below the surface of the conveyor belt 2 and extending over about 100 mm in the direction D, is equipped with a plurality of (e.g. four) conveyor belts 30 taking over from the conveyor belt 2 for the purpose of conveying the postal items in the direction D. The unstacking plate 6 has a fixed position and extends vertically from the bottom of the drop-forming channel C to a height that is higher than the height of the largest format of flat postal items. The plate 6 extends in the unstacking direction P that is perpendicular to the direction D of movement of the postal items through the motor-driven magazine M. In its bottom portion, the unstacking plate is provided with two openings. A perforated drive belt 8 co-operating with a suction nozzle mounted therebehind is mounted to move inside each of the openings. The belt 8 moves in the same plane as the surface of the unstacking plate in the direction P.

In accordance with the invention, a blower member or strip 13 is arranged to be retractable into the unstacking plate 6 above the unstacking perforated belt 8. In FIG. 3, the blower strip 13 is in the deployed position, i.e. in its active situation. In its deployed position, the blower strip 13 projects beyond the surface of the unstacker plate 6 on the same side as the magazine M. The blower strip is more particularly arranged in a manner such as to direct a stream of air 14 (seen in FIG. 4) below it, more particularly in a manner such that the stream of air tilts slightly relative to the vertical towards the magazine M. The blowing pressure of said stream of air 14 is about 1 bar.

Figure 5:
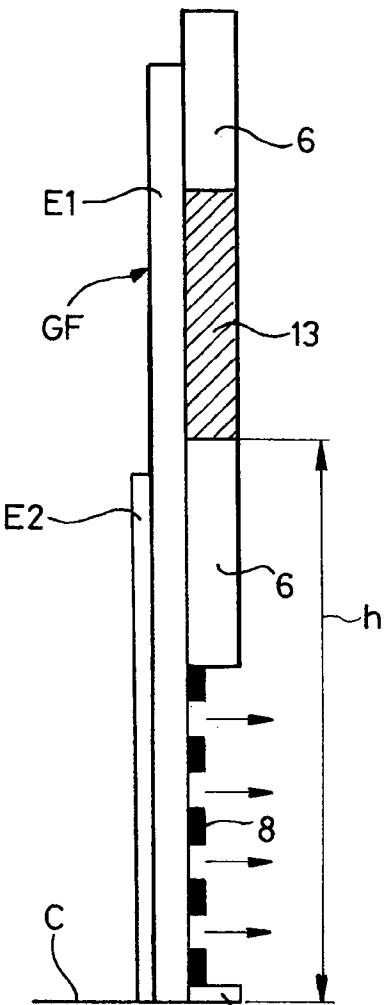
FIGS. 4 and 5 are section views of unstacker apparatus of the invention when the blower strip is respectively in the deployed position and in the retracted position.
Figure 4:
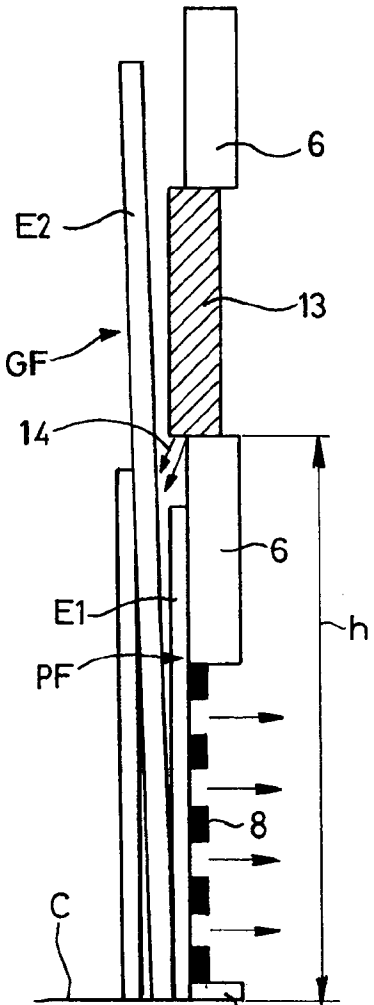

As can be seen in FIGS. 4 and 5, the bottom edge of the blower strip 13, from which edge the stream of air 14 is released, is disposed relative to the bottom of the drop-forming channel at a height h that is slightly greater than the height of a postal item PF that is considered to be of small format.

Therefore, when a small-format postal item PF becomes the first postal item E1, as in FIG. 4, the blow strip 13 in the deployed position does not obstruct pressing the face of said postal item E1 against the unstacking plate 6, and suction and drive by the perforated belt 8. The jet of air 14 then blows over the top of the first postal item E1, and penetrates between the first and the second postal items, thereby parting the first postal item E1 and the second postal item E2 slightly and preventing them from being ejected simultaneously or as a bunch.

When, as shown in FIG. 5, the first postal item E1 is a postal item GF that is considered to be of large format, the blower strip 13 retracts into an opening in the unstacking plate 6 so as not to stand proud relative to the surface of the unstacking plate 6.

In a first preferred embodiment of the invention, the blower strip 13 is more particularly a blower strip that is normally in the deployed (proud) position and that retracts into the unstacking plate under thrust exerted by contact by a large-format first postal item that is pushed by the postal items succeeding it in the stack, by the paddle 3 and by the conveyor belts 20.

Figure 6:
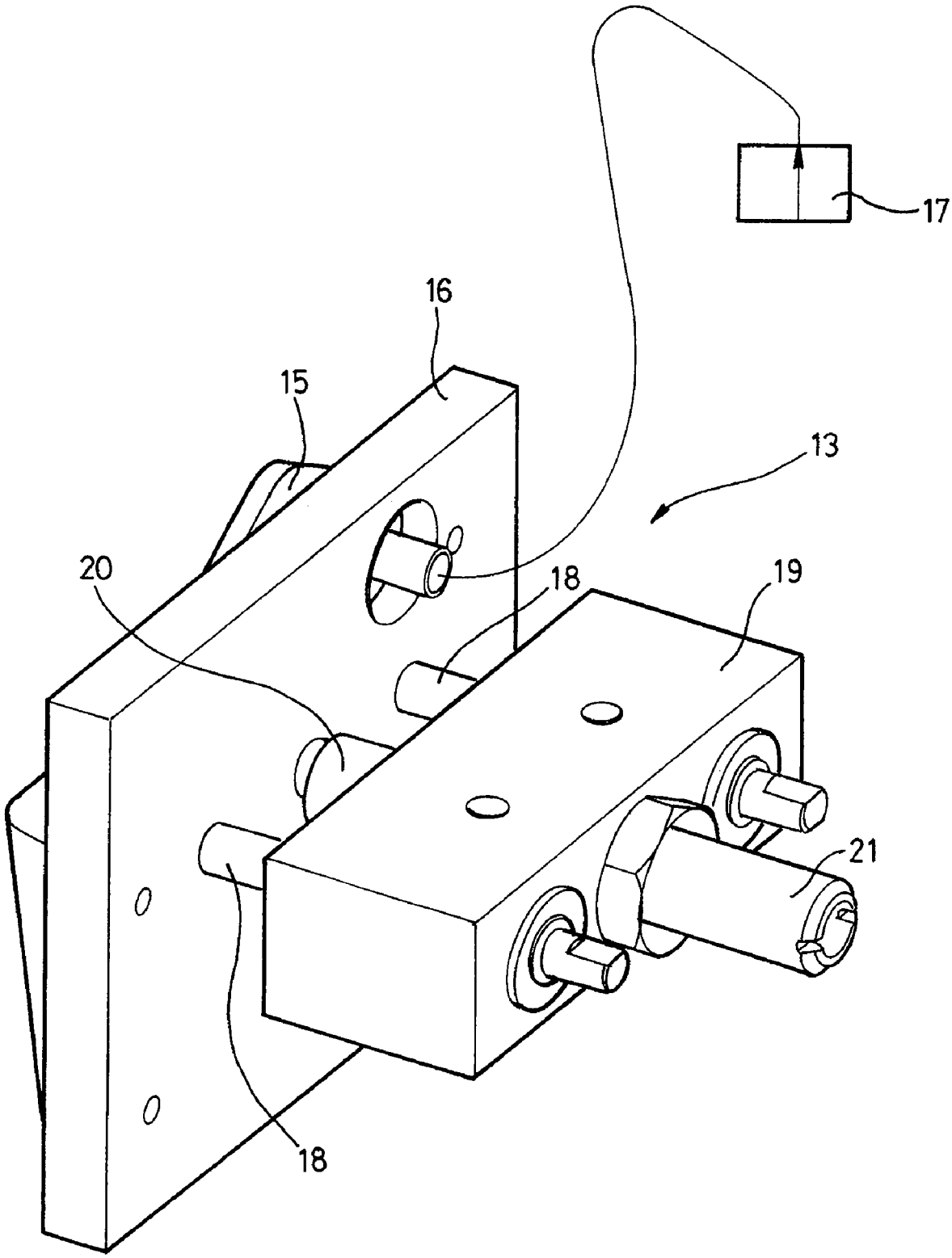
FIG. 6 is a more detailed back view of a blower strip of the invention.

FIG. 6 shows in more detail the retractable blower strip 13 from behind. Said blower strip 13 comprises a blower nozzle 15 fixed to a frame 16 and connected to an air dispenser 17. The frame 16 is mounted to move in translation along guide rods 18 on a stationary support 19 disposed behind the unstacking plate 6. A resilient return element and more particularly a spring 20 disposed between the fixed support 19 and the frame 16 pushes the frame and the blower nozzle towards the magazine M until it reaches an abutment position. The stiffness of the spring can be adjusted by means of a calibration screw 21. The force exerted by the spring 20 is very small and must be small enough to be overcome by the force exerted by a large-format postal item coming to bear against the blower nozzle 15 on being pressed against the unstacking plate 6.

Naturally, the movement of the blower strip 13 that is described above as being a movement in translation can also be a movement in rotation, e.g. about an axis extending in the unstacking plate.

Figure 7:
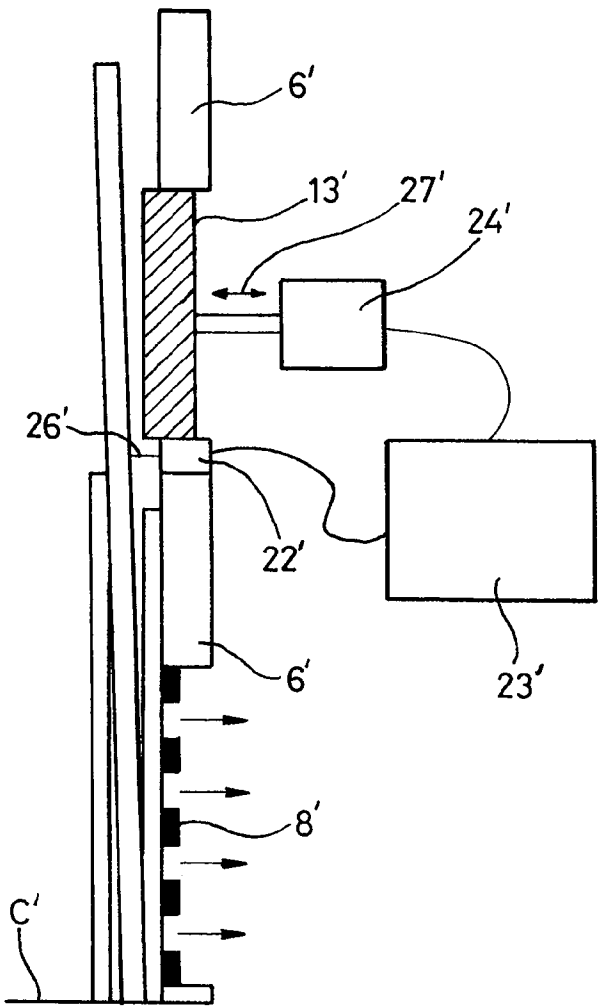
FIG. 7 shows a second embodiment of unstacker apparatus of the invention.

Another embodiment of the invention is shown in FIG. 7. This apparatus of the invention further comprises a sensor 22' suitable for detecting that a large-format postal item GF is approaching the unstacking plate and is thus soon to come into contact with the blower strip 13' that is normally in the deployed position. Said sensor 22' then sends a signal to a control system 23' for controlling drive apparatus 24' arranged to move the blower strip 13' from a deployed position to a retracted position in which it is retracted into the blower plate 6'.

The sensor 22' is more particularly a reflex sensor making it possible to detect whether pressing a postal item against the unstacking plate 6' might be disturbed by the blower strip 13' in the deployed position. Said sensor 22' is disposed in the unstacking plate 6' at the same height as the bottom edge of the blower strip 13' or immediately therebelow as shown in FIG. 7. It sends a light beam 26' horizontally towards the postal items and senses reflection of said light beam off a postal item if said postal item is situated in a zone close to the sensor and thus close to the plate, i.e. les than 10 mm away from the unstacking plate 6'. It is thus possible to detect those postal items approaching the unstacking plate that are taller than a height h and that are thus of large format.

Naturally, other sensors can be used, such as a barrier photoelectric cell with a transmitter and a receiver that are disposed at a height h parallel to the unstacking plate or a contact sensor constituted by a finger or switch projecting relative to the unstacking plate.

The drive apparatus 24' is more particularly a hydraulic piston that moves the blower strip in reciprocating translation as indicated by the double-headed arrow 27'. Retraction of the blower strip is then controlled and driven.

In accordance with the invention, the blower strip can blow continuously or intermittently. In continuous mode, a stream of air is delivered continuously by the blower strip, regardless of whether said blower strip is in the deployed position or in the retracted position. In order to mitigate certain disturbances caused by the jet of air while the blower strip is blowing in the retracted position and that might part the large-format postal item from the unstacking plate, the jet of air can be interrupted whenever the blower strip retracts into the unstacking plate 6. For example, the jet of air can be interrupted by means of a solenoid valve system.

In accordance with the invention, the height h defines a boundary between the size of a large-format postal item GF and of a small-format postal item PF, and is more particularly chosen as a function of the size of the postal items that are most affected by bunching. This height h is about fifteen centimeters (cm).

Naturally, the invention is in no way limited to the details of the above-described embodiments but rather it extends to any variant that is obvious to the person skilled in the art.

Naturally, it is possible, in addition to the retractable blower strip of the invention, to install another blower strip that is identical to the blower strip of the prior art EP 0 562 954 for the purpose of also blowing over the tops of large-format postal items.

The blower strip of the invention can also be locked in the retracted position when unstacking large-format postal items only.

It is also possible to imagine apparatus in which, in response to detection of a large-format postal item approaching the unstacking plate, the blower strip automatically retracts vertically upwards so as to blow over the tops of the large-format postal items.

The invention claimed is:

1. Unstacker apparatus for unstacking flat items, the unstacker apparatus comprising a flat item feed magazine, an unstacking plate disposed in alignment with said feed magazine, wherein said feed magazine is configured such that flat items disposed in a stack and on edge are moved in a certain direction until they reach said unstacking plate disposed in alignment with said feed magazine, said unstacking plate being configured such that the flat items are ejected one-by-one in a perpendicular direction that is perpendicular to said certain direction, the unstacker apparatus further comprising a blower member disposed so as to blow a jet of air onto the flat items, wherein said blower member is mounted in a manner such as to be retractable into the unstacking plate.

2. Unstacker apparatus according to claim 1, in which said blower member is mounted to be retracted by moving in translation in said certain direction.

3. Unstacker apparatus according to claim 2, further comprising a resilient return element arranged such that said blower member retracts into the unstacking plate against drive from said resilient return element.

4. Unstacker apparatus according to claim 2, further comprising a sensor and a mechanical control element configured such that said blower member retracts into said unstacking plate under drive from said mechanical control element in response to reception of a signal delivered by said sensor.

5. Unstacker apparatus according to claim 4, in which said sensor is an optical reflection sensor disposed in the unstacking plate.

6. Unstacker apparatus according to claim 4, in which said sensor is a mechanical contact sensor.

7. Unstacker apparatus according to claim 4, in which said sensor is an optical barrier sensor.

8. A machine for handling postal items, said machine comprising an unstacker apparatus according to claim 1.

* * * * *